United States Patent [19]

Sanders

[11] 4,085,901

[45] Apr. 25, 1978

[54] APPARATUS FOR PACKAGING LINEAR MATERIAL

[75] Inventor: James E. Sanders, Newark, Ohio

[73] Assignee: Owens-Corning Fiberglas Corporation, Toledo, Ohio

[21] Appl. No.: 801,191

[22] Filed: May 27, 1977

Related U.S. Application Data

[63] Continuation of Ser. No. 590,756, Jun. 26, 1975, abandoned.

[51] Int. Cl.[2] ..... B65H 54/00

[52] U.S. Cl. ..... 242/18 G; 65/11 W; 242/18 A; 242/18 PW

[58] Field of Search ..... 242/18 G, 18 A, 18 PW, 242/25 A, 25 R; 65/11 W

[56] References Cited

U.S. PATENT DOCUMENTS

| | | | |
|---|---|---|---|
| 3,090,570 | 5/1963 | Cunningham et al. | 242/18 G |
| 3,924,817 | 12/1975 | Symborski | 242/18 G |

*Primary Examiner*—Stanley N. Gilreath

*Attorney, Agent, or Firm*—Kenneth H. Wetmore; Ronald C. Hudgens; Philip R. Cloutier

[57] ABSTRACT

The present invention embraces apparatus for packaging linear material. The invention comprises a driven rotatable collet having a package collection region and a temporary collection region, a linear material engaging member having a recess and a guide surface terminating at one end at the recess; and means for moving the member so that the linear material is moved along the collet between the package collection region and the temporary collection region, the guide surface being disposed to laterally guide the linear material into the recess and gather the linear material into a bundle therein when the member is moved along a path to move the linear material from the package collection region to the temporary collection region, the recess being disposed tending to hold the linear material therein and thus urge movement of the linear material with it when the member is moved back along the path such that the material releases from the recess at its package collection region.

5 Claims, 18 Drawing Figures

APPARATUS FOR PACKAGING LINEAR MATERIAL

This is a continuation, of application Ser. No. 590,756, filed June 26, 1975, now abandoned.

BACKGROUND OF THE INVENTION

It has been conventional practice, particularly in the formation of strands of filaments from heat-softened mineral material such as glass to wind the strand of filaments upon a rotating sleeve at a speed desired for the attenuation of filaments of a particular diameter and when the package of wound strand is completed, the attenuation and winding operation is interrupted by the operator de-energizing the motor rotating the collecting sleeve or spool, bringing the spool or sleeve to a condition of rest, breaking the strand of filaments manually, and removing the strand package from the winding collet.

The operator manually places a strand-free sleeve or collector upon the collet and initiates rotation of the collet to re-establish attenuation of filaments by winding. During the start-up or initial period of rotation of the collet and the start-up or initial period of rotation of the collet and sleeve, the filaments formed are of larger size than desired and are of varying size until the collet is brought up to the required winding speed.

During this period the filaments are initially wound upon an extension of the collet until the collet reaches the desired winding speed at which time the skilled operator moves the strand manually into cooperative association with a traverse means which performs the function of distributing the strand material lengthwise of the sleeve or collector in superposed layers in the formation of a complete package. When the package is completed and rotation ceases, the operator removes the initially wound strand from the collet which is discarded as waste material.

There has been an effort for years to develop better methods and apparatus for collecting strand of newly formed filaments. U.S. Pat. No. 3,539,317, U.S. Pat. No. 3,666,431, U.S. Pat. No. 3,090,570, U.S. Pat. No. 3,292,871 and U.S. Pat. No. 3,408,012 show some of the prior art winders.

Prior winder systems have not been fully satisfactory. Some systems require very skilled operators for manually starting package build. Some systems require precise speed relationship between collets for strand transfer. Other systems are dependent upon the surface adhesion characteristic of the collet and the strand. With these systems strand with some sizings will not work.

Therefore, there is a need for a reliable mechanical system for starting up wound strand packages, winding packages, ending packages when they are complete, and transferring strand from a completed package collet to an empty collet ready to wind a package.

SUMMARY OF THE INVENTION

The present invention embraces apparatus for packaging linear material. The invention comprises a driven rotatable collet having a package collection region and a temporary collection region, a linear material engaging member having a recess and a guide surface terminating at one end at the recess; and means for moving the member so that the linear material is moved along the collet between the package collection region and the temporary collection region, the guide surface being disposed to laterally guide the linear material into the recess and gather the linear material into a bundle therein when the member is moved along a path to move the linear material from the package collection region to the temporary collection region, the recess being disposed tending to hold the linear material therein and thus urge movement of the linear material with it when the member is moved back along the path such that the material releases from the recess at its package collection region.

An object of the invention is improved apparatus for moving linear material between a package collection region and a temporary collection region.

Another object of the invention is an improved apparatus for gathering strands from their package collection regions into a bundle and moving the single bundle to a temporary collection region.

Still another object of the invention is an improved apparatus for moving a gathered bundle of strands from a temporary collection region to deliver each strand to its package collection region.

Other objects and advantages will become apparent as the invention is described in more detail with reference to the accompanying drawings.

DESCRIPTION OF THE PREFERRED EMBODIMENTS

Figure 1:
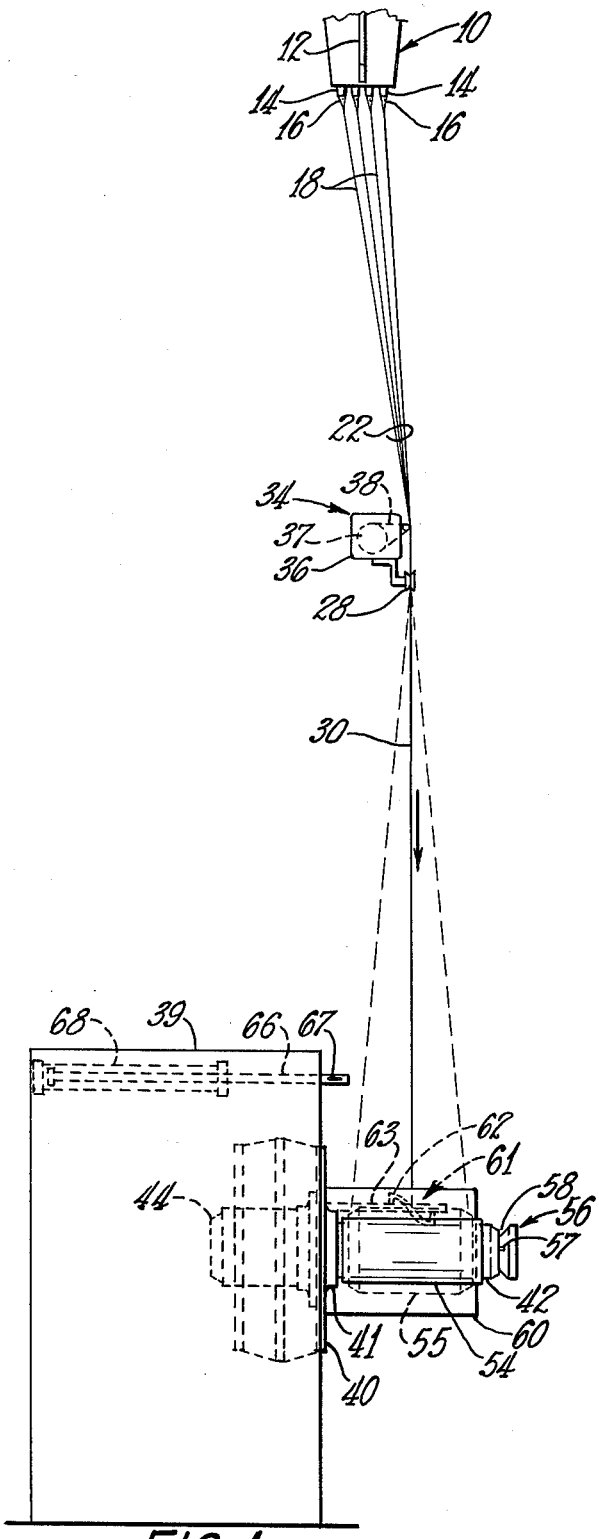
FIG. 1 is a side elevation view illustrating a form of automatic winder apparatus embodying the invention.
Figure 2:
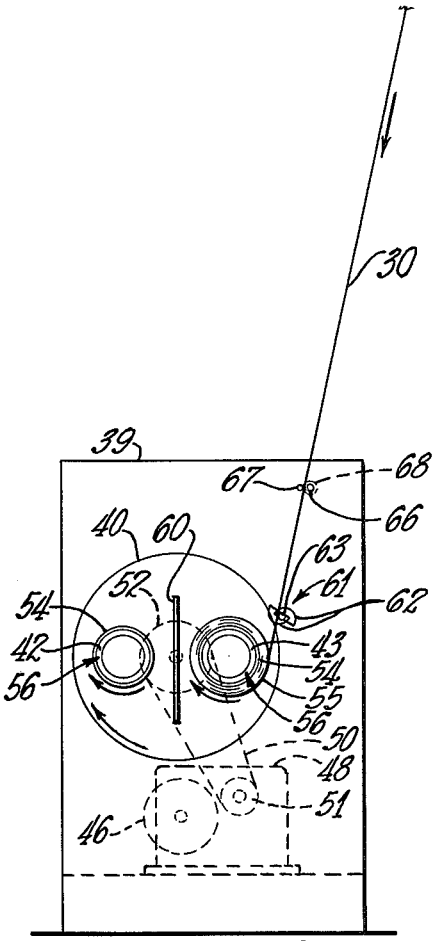
FIG. 2 is a front elevation view of the winding apparatus illustrated in FIG. 1.
Figure 3:
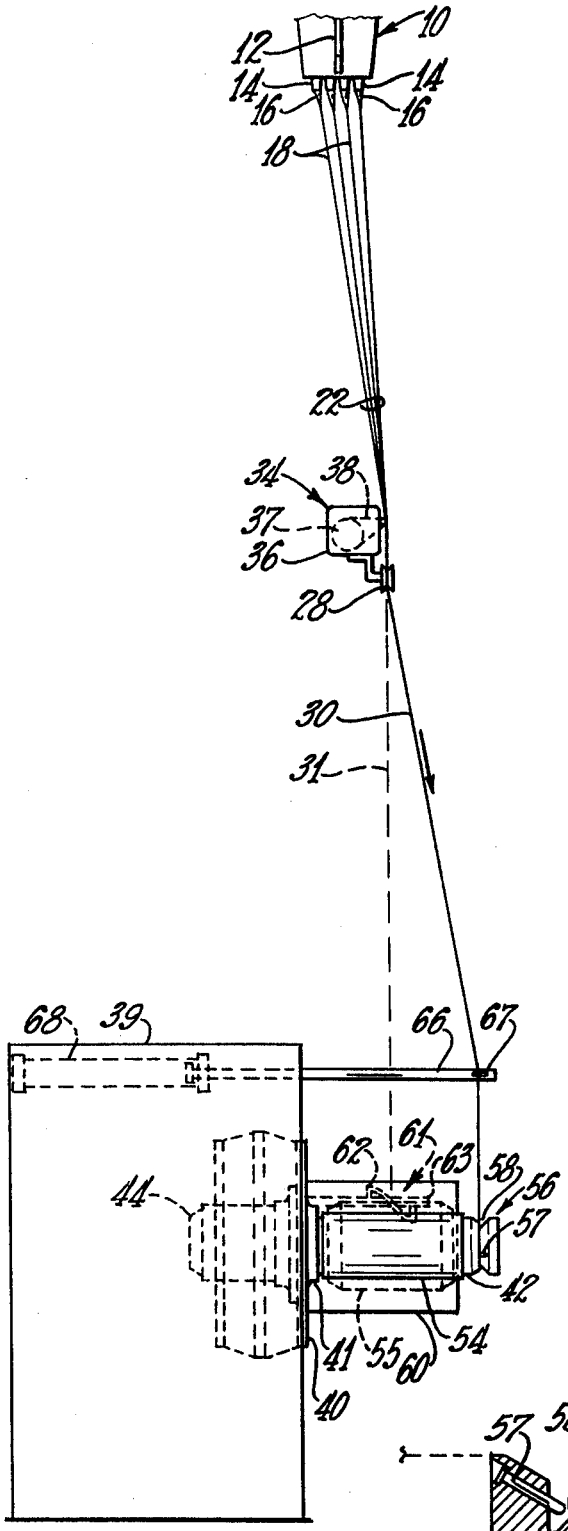
FIG. 3 is another side elevation view of the winding apparatus illustrated in FIG. 1.

Referring to the drawings in detail and initially to FIGS. 1, 2 and 3 there is illustrated a conventional type of stream feeder or bushing 10 containing a supply of heat softened filament forming material. The heat softened material can be a mineral material such as glass. The feeder 10 has a floor provided with a comparatively large number of orificed tips or projections 14 flowing streams of glass 16 and the streams are attenuated to filaments 18 arranged in a group 22.

The feeder 10 is formed of any alloy of platinum and rhodium or other materials capable of withstanding the intense heat of molten glass.

The feeder is provided with terminals 12 connected with a source of electrical energy for heating the glass or other mineral or heat-softenable material. The energy input is controlled by conventional means (not shown) to maintain the material in the feeder at a proper viscosity to promote the formation of uniform streams 16.

The group of filaments 18 is converged by gathering shoe or member 28 to form a strand 30. The filaments of the group are coated with a lubricant size or other coating material by means of an applicator arrangement 34 of conventional construction shown in FIG. 1. The applicator includes a receptacle 36 in which is held a roll 37 immersed in the coating material and an endless belt 38 being drawn by roll 37 acquiring a thin film of the size coating material which is transferred to the filaments by wiping contact of the filaments with the film of size or coating on the belt.

FIGS. 1, 2 and 3 illustrate the automatic winding and package forming apparatus which is inclusive of a housing 39 enclosing the actuating and control components for carrying out or performing the steps in the method of attenuating the filaments and automatically packaging the strands of the filaments. U.S. Pat. No. 3,408,012 describes conventional control means for the winder. Such patent is herein incorporated by reference.

The portion of the indexable and rotatable turret or head 40 at the front of the housing 39 is provided with two hollow boss portions 41 enclosing journal bearings on which are journally supported winding collets 42 and 43. The head 40 is journally supported by means contained within the housing. Each of the collets 42 and 43 is individually driven by a motor 44, one of which is illustrated in FIG. 1. The motors 44 are carried by the head or turret 40. The head or turret is indexible to two positions. The collet 43, in FIG. 2 is shown in package winding or forming position or location while the collet 42 is in a diametrically opposed standby position.

The head 40 is adapted to be indexed in two positions in order to move the collet with a completed package away from the winding position and an empty collet into winding position for the formation of a new package. The head 40 is rotated by a motor 46 through gear reduction mechanism contained within a housing 48 and through suitable drive means, such as belt 50 and sprockets 51 and 52. The energization of the motor 46 is controlled by a suitable indexing means of conventional construction timed to index or rotate the head 40 upon the formation of a completed strand package at the winding station.

Each of the collets 42 and 43 is adapted to accommodate strand collecting means such as a tubular sleeve 54 on which a package is wound. Each of the motors 44 for rotating the winding collets and strand collectors or tubular sleeves carried thereby is of a type in which the speed may be varied for the purpose of progressively reducing the speed of rotation of the collet at the winding station as the strand packages increase in diameter during the winding operation.

The peripheral region of each of the collets 42 and 43 is formed with conventional longitudinally extending recesses in which are disposed bars or friction shoes (not shown) which are resiliently biased radially outwardly of the collets to frictionally grip the strand collectors or tubular sleeves to assure rotation of the same with the collets.

Disposed between the winding collets 42 and 43 and fixedly mounted by the head 40 is a baffle means 60. This baffle means separates the package collection regions of the collets.

The winding apparatus includes strand traverse means 61 for distributing the strands lengthwise of the package and for oscillating the strand during traverse of the strand lengthwise of the package in order to effect crossing of individual convolutions or wraps of the strands as they are collected on the packages. In the embodiment illustrated, a strand oscillator 62 is supported by a reciprocal shaft 63 which extends into the housing 39.

Fixedly supported on the shaft 63 is a strand oscillator or strand guide means 62 which is driven by a variable speed electrically energized motor for guiding and traversing the strand as it is collected upon the collet at the winding station. It is conventional to have a collector or tube placed upon the collet on which the strands are wound. As the strand travels at comparatively high linear speeds of upwards of 15,000 feet or more per minute, the strand oscillator 62 is rotated at comparitively high speeds to effect high frequency oscillation of the strand to effect a crossing of individual convolutions or wraps of strand on the collet.

The collet as shown can be described as having a package collection region and a temporary collection region. The collection region is the area where the strand is wound into a package 55. The temporary collection region of the collet is shown as the end cap assembly 56 in FIGS. 1, 2 and 3. The end cap assembly 56 is shown to have a guide surface or groove 58 running circumferentially around the end of the collet in the temporary collection region and a pin or member 57 projecting or extending out into the groove. This end cap assembly 56 will be more fully described later.

FIGS. 1 and 2 show the push off or knock off assembly in its retracted position. This knock off assembly includes a rod 66 which is journally mounted in the housing 39. The knock off mechanism may be activated by a device 68 which is shown to be an air cylinder activating device. The knock off can of course be activated by other conventional means.

The knock off or push off is shown in its extended position in FIG. 3. As shown the L-shaped projection 67 extending outwardly and forward of the rod 66 has contacted the strand 30 and moved it to the end region 56 of the collet 42. The strand 30 has thus been moved from its natural running line 31 where the strand is automatically moved because of tension during strand winding and because of the strand knock off design as will be discussed later. The strand 30 runs generally vertically from the projection 67 to the end cap or end region of the collet. The strand enters the grooved portion 58 of the end region and is engaged or captured by the member or pin 57. The end region 56 of the collet will be more fully described herein.

The push off or knock off mechanism serves a dual purpose. The knock off may be used to hold the strand 30 from its natural running position 31 in the package collection region while it is being collected in the temporary collection region 56. Also, the knock off may be used to push the strand from its natural running position 31 in the package collection region upon completion of a package thereon.

Figure 13:
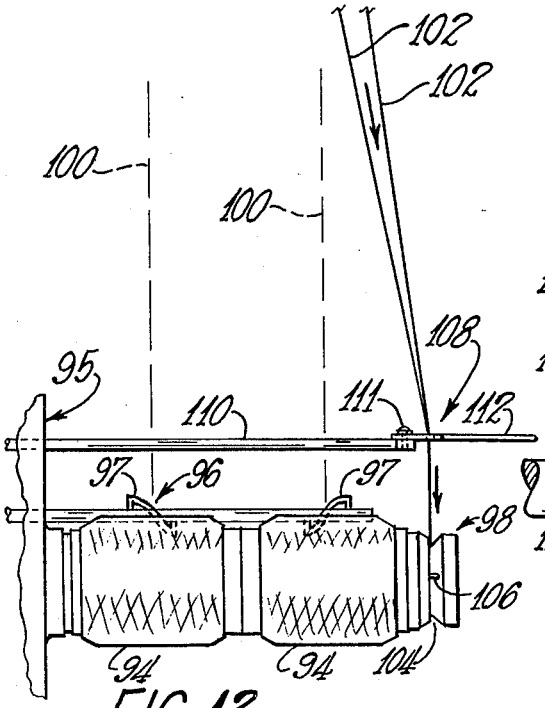
FIG. 13 is an enlarged side view of apparatus for winding multiple packages according to the principles of the invention shown in FIGS. 1 and 2.

A simple push off rod 66 and L-shaped projection 67 has been described as the push off mechanism. This mechanism may be of other configurations. For example, in FIG. 13 a more complicated push off or knock off assembly is shown and will be fully described later. FIGS. 1, 2 and 3 show a winder forming a single package on a collet. This is shown as an example. The invention herein encompasses two or more packages being collected on a collet. For example, FIG. 13 shows two packages being collected on a collet.

Figure 4:
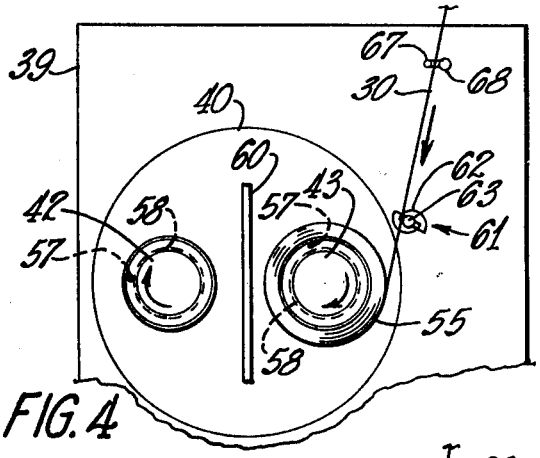
FIG. 4 is a schematic view illustrating the method step of collecting or winding linear materials to form a package, the package being shown as substantially completed.
Figure 5:
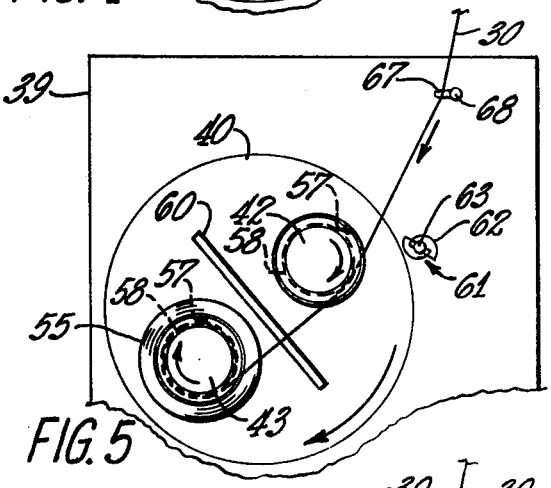
FIG. 5 is a view similar to FIG. 4 illustrating an indexing movement of the collet supporting head wherein the completed package is being moved away from the winding station and an empty collet being moved toward the winding station.
Figure 6:
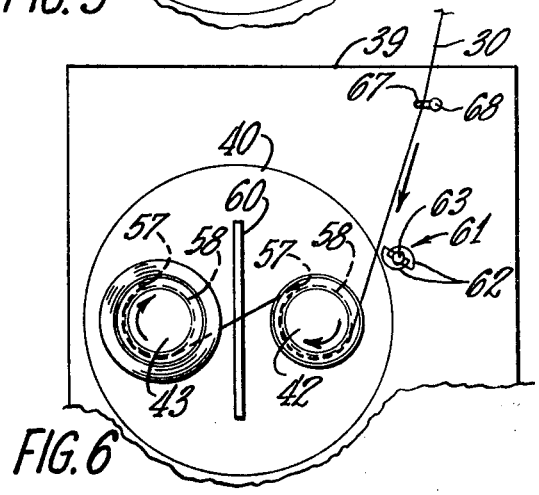
FIG. 6 is a view similar to FIG. 5 illustrating the transfer of the strand onto the empty collet.

FIGS. 4, 5 and 6 show the method of automatic transfer of the strand from one collet to another on a winder like that shown in FIGS. 1, 2 and 3. First, the strand 30 is moving along its normal strand line 31, being oscillated by the oscillator 61 and being wound in the package collection region of the collet 43. When the package has been completed the push off or knock off mechanism is activated. The push off rod 66 is moved forward and brings the strand 30 into contact with the push off projection 67. The knock off moves the strand from the package collection region of the collet to the temporary collection region or end cap region of the collet 43.

As shown in FIG. 4 there are two collets 42 and 43 mounted on the indexing head 40. Between the collets there is a center plate 60. The center plate extends out separating the collets in their package collection region but terminates prior to the temporary collection region. Each collet in its temporary collection region or end cap section has a circumferential guide surface or groove 58 and a fixed stationary member 57 extending into the groove. The groove 58 and member 57 are shown in more detail and will be discussed in accordance with FIGS. 7 and 8. In FIG. 4 the collet 43 is shown in the winding location or winding position and a package is being completed.

FIG. 5 shows the knock off mechanism extended and having moved the strand 30 laterally along the collet into the temporary collection region of the collet 43. The linear material or strand 30 advancing to the first collet is contacted by the second rotating collet 42 in its temporary collection region to engage the linear material 30 on the member 57 to move the linear material with it and thereby to begin collection of the material in the temporary collection region of the second collet 42 and to sever the material between the collets 42 and 43. As shown, the indexing head 40 moves the completed package 55 on the collet 43 from the winding location and the second rotating collet 42 on the head into the winding location. The strand 30 enters the circumferential guide surface or groove 58 as it is shown and engages the pin 57 on collet 42.

FIG. 6 shows the indexing of the head 40 completed. The collet 42 is now in the winding position. As shown the strand 30 has been captured or engaged by the pin 57 of the second collet 42. The strand has been guided beneath the pin and upon rotation of the collet 42 the strand has been bent over the member or pin 57. Thus, the member 57 captures or engages the strand to move the strand with it upon rotation and thereby begin collection of the strand in the temporary collection region of the collet 42. Also, the strand between the collets 42 and 43 is severed. As shown the collet 42 is pulling or moving the strand between the collets in a clockwise direction as it is being collected in the temporary collection region of the second collet 42. Also, the collet 43 is holding the strand stationary or moving the strand between the collets in a clockwise direction. Thus, it can be seen that the strand between the collets is being pulled in opposite directions and thus fractures causing severance of the strand between the collets. The finished package 55 is then doffed from the stationary collet 43.

The strand 30 or linear material is now being collected upon the temporary collection region of the collet 42. The natural running line of the strand 30 is toward the package collection region of the collet 42. Without the push off mechanism being extended the strand will automatically move laterally along the second collet from the temporary collection region to the collection region to begin package formation. However, the knock off or push rod can be kept in the extended position until the collet is brought up to a desired speed. Then the knock off is retracted and the strand moves along the collet to the package collection region.

Figure 7:
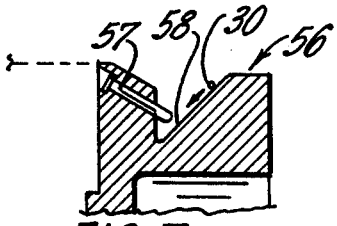
FIG. 7 is a partial sectional view of the end region of the collet shown in FIG. 1 and shows the strand movement thereon.
Figure 8:
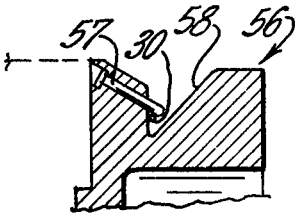
FIG. 8 is a partial sectional view of the end region of the collet shown in FIG. 1 and shows the continued movement of the strand shown in FIG. 7.

FIGS. 7 and 8 show a close up section of the temporary collection region as shown in FIG. 1 through 6. The end cap or temporary collection region 56 is shown to have a groove or guide surface 58 and a member of pin 57. The guide surface 58 can for example be a long narrow furrow or channel which runs circumferentially around the collet. The pin can extend into or above the groove or guide surface 58. Also, the number 57 can be mounted upon a shoulder or ridge on the collet and thus, the guide surface could be the end circumferential surface region of the collet without a groove.

As shown, the collet has in its temporary collection region a circumferential surface region and a member having a portion extending generally axially of the collet in spaced apart relation outwardly of the circumferential surface region. The member terminates to define an opening to a space between the outwardly disposed portion of the member and the circumferential surface region so that during rotaton of the collet prior to package formation linear material or strand extended along a path disposed in general crossing relationship to the axis of rotation of the collet can be moved laterally of the path in a direction axially of the collet along its circumferential surface. The strand moves through the opening in the space between the circumferential surface region and the outwardly disposed portion of the member for catching engagement by the member to move the strand with it and thereby to begin temporary collection of the linear material or strand in the temporary collection region.

As can be seen by the embodiment in FIG. 7, the member 57 is a fixed stationary pin or peg extending into the groove 58. The strand 30 moves along the guide surface or groove 58 into a position beneath the member or straight fixed pin 57. FIG. 8 shows the strand in position beneath the member 57. The strand is engaged or captured by the member 57. The strand can be held by being wedged under the pin. During rotation of the collet the strand is turned or bent across the member 57 to engage the strand on the member to move the strand with it and thereby to begin collection of the material in the temporary collection region.

The member 57 is shown to be an elongated straight pin. However, the member could be a curved rod or hook. Also, the member can extend over the guide surface at an acute angle or some other angle so that the strand becomes wedged or trapped between the guide surface and the member upon moving beneath the fixed securely fastened member.

The temporary collection region is shown to be at the free end of the collet. However, it is within the scope of the invention to have the temporary collection region at another location on the collet, for example, near the other end of the collet. Also, the temporary region could be at the center region of a collet which was winding more than one package. On a collet which is winding more than one package, there can be more than one temporary collection region. For example, if a collet were winding two packages there could be one temporary collection region in the center region of the collet and a second temporary collection region at the end region of the collet.

Figure 10:
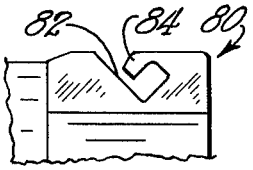
FIG. 10 is a partial sectional view of another embodiment of the end region of a collet according to the invention.

FIG. 10 shows another embodiment of a temporary collection region. The end cap or temporary collection region 80 performs the functions as discussed earlier. The member 84 engages a strand guided beneath it by the guide 82 as the strand is advanced through the temporary collection region to begin collection thereon. As shown in the embodiment 80 the member 84 and guide or groove 82 are one integral part and can be of a one piece construction. Such a one piece construction could be formed and attached to or set into the circumferential surface of the collet in the temporary collection region.

Figure 11:
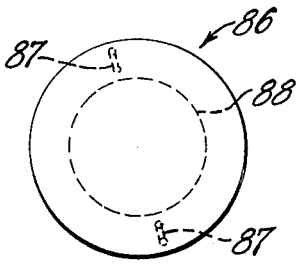
FIG. 11 is an enlarged front view of the end region of a collet embodiment.
Figure 12:
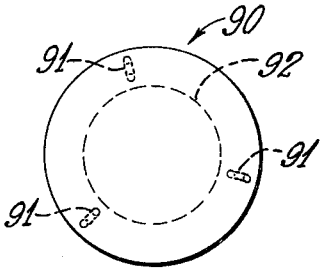
FIG. 12 is an enlarged front view of the end region of a collet embodiment.

FIGS. 11 and 12 are end views of other embodiments of a collet showing the temporary collection region. In FIG. 11 is shown a grooved guide surface as discussed earlier with two members 87. As discussed earlier, these members 87 can be fixed stationary pins extending into the grooves 88 in the temporary collection region 86. The fixed members 57 are shown to be 180° apart. FIG. 12 shows three members 91 similar to the members discussed earlier extending into a groove 92 and in the temporary collection region 90. The fixed stationary pegs or pins 91 are shown to be equally spaced around the collet. It is understood that more than one member may be used and the members may be located in different positions around the collet.

Figure 9:
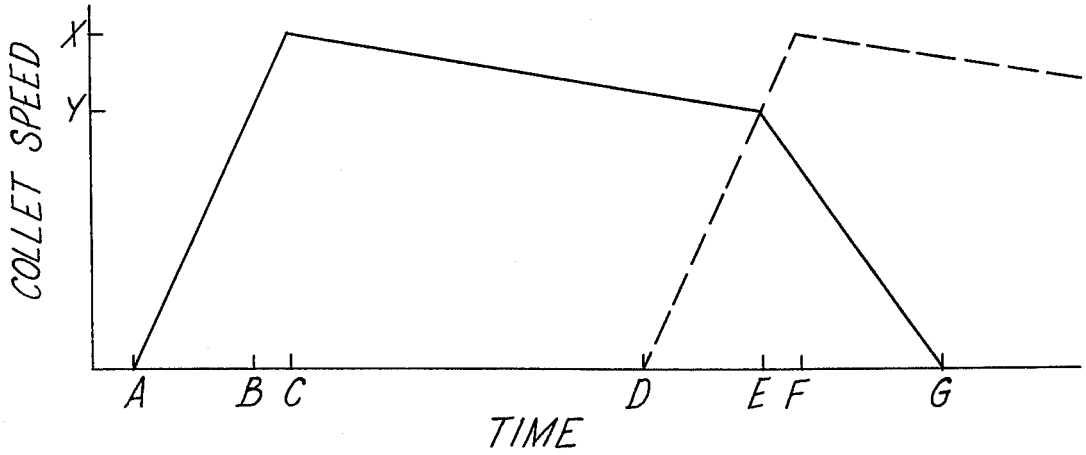
FIG. 9 is a time-action diagram showing the movements of the collets shown in FIG. 1.

FIG. 9 is a time-action diagram showing the time and approximate collet speeds for the movements of the collets as discussed in FIGS. 1–6. The speed of the first collet is shown in a continuous line and the speed of the second collet is shown with a dashed line.

From points A to C the first collet is accelerating to reach the collet speed X desired to begin package build. Upon reaching the desired speed X at time C the strand is oscillated and the package is wound upon the first collet in the package collection region. As the package builds the collet speed is conventionally slowed from speed X to speed Y during the package winding time. The speed change can be linear as shown in FIG. 9 or it can be at nonlinear rate. Upon completion of the package the collet speed is shown as Y. The package winding time for the first collet is thus shown from position C to E. As the first package is nearing completion the second collet is rotated. This rotation is begun at time D and the collet is brought up to the desired winding speed X shown at time F.

The transfer and rotation of the indexing head or turret takes place at point E, the time the two collet graphs cross. At this time, point E, the first package has been completed and the push off arm or knock off has pushed the strand to the temporary collection region of the first collet. The turret head is indexed and the strand is brought into contact with the temporary collection region of the second collet. Upon contact with the temporary collection region of the second collet strand is engaged or captured by the member in the temporary collection region to begin collection of the strand thereof. Thus, the head is rotated to move the second collet into package collection location and to move the first collet away from package collection location. The strand between the collets is severed as discussed earlier and the strand is now being collected upon the temporary collection region of the second collet.

So, the transfer of the strand from one collet to the other takes place in the time frame of time E on the chart in FIG. 9. The first collet is then stopped by a brake between times E and G. After the collet has been stopped, the package is doffed. The first collet is readied for winding another package. From time E to F the second collet is being brought up to package collection speed and the knock off is extended so that the strand is being collected in the temporary collection region of the second collet.

At time F the second collet is up to the desired package collection speed X to begin package build. The knock off retracts and the strand moves laterally across the collet to the package collection region. The strand is then oscillated and wound in the package collection region and the cycle just described begins again.

FIG. 13 shows another embodiment of the present invention. The double package collet shown can be attached to a winder 95 like that described in FIGS. 1, 2 and 3. Two strands run along the paths 100 and are oscillated by the oscillator assembly 96 with the strand engaging portions 97. This strand oscillating assembly is similar to that described earlier. The two strands are wound on the collet to form two packages 94.

As stated, this double package collet is another embodiment of a collet that can be used on the winder described in FIG. 1. This double package could be on a turret head along with a second double package collet as described earlier.

At the end region of the double package collet is a temporary winding region 98 which is similar to that described earlier. There is a circumferential guide or groove 104 and a fixed stationary pin 106. When the push off or knock off assembly is in its extended position (as shown in FIG. 13), the strands 102 are engaged by the member and wound in the temporary collection region. Upon retraction of the knock off arm the strands move laterally across the collet into their separate package collection regions on the collet.

Upon completion of the packages 94 the push off arm extends to move both strands to the temporary collection region 98. The push off assembly is shown in FIG. 14 and will be described more fully.

As the push off extends it contacts the first strand on the guide surface 114. The strand moves along the guide surface and is removed from its strand oscillator assembly as it moves to the recess 115. As the push off further extends it contacts the second strand on the guide surface 114. This strand also moves along the guide surface and is removed from its strand oscillator assembly to the recess 115. The first strand being so removed that it does not become engaged in the second oscillator as it moves to the temporary collection region. As the push off extends still further both strands are moved to the recess 115 and gathered into a single bundle 102*a* as they are moved to the temporary collection region for engagement or capture and collection thereon. The strand transfer can take place as described earlier.

The push off or knock off assembly 108 is shown attached to the support arm 110 by the attaching means 111. The attaching means 111 can be a bolt means passing through the slot 113 in the push off 112. Activating means moves the support 110 and the push off 112 back and forth generally along a path parallel to the axis of rotation of the collet. The push off is shown in spaced relationship above the collet between the collet and the strand supply means. The push off and its function are more detailedly described below in the discussion of FIG. 14.

Figure 14:
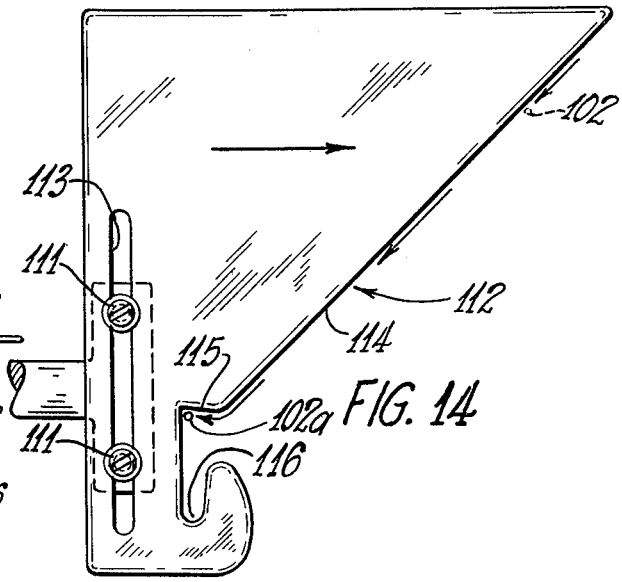
FIG. 14 is an enlarged plan view of apparatus shown in FIG. 13.

FIG. 14 is an enlarged view of the strand push off 112 shown in FIG. 13. The guide surface 114 contacts the strands as they are being oscillated back and forth during package formation and removes them from the oscillators and moves them to the notch or recess area 115. The guide surface 114 is shown to be in a position oblique to the path of movement of the knock off. As shown in FIG. 13 the guide surface 114 contacts both strands and moves them together into the notch or recess 115 when the knock off 112 is being moved in the direction of the temporary collection region of the collet. The closed slot or elongated hole 113 allows the attachment means 111 to be adjustable so that the knock off 112 may be aligned with the moving strands so that during its movement the guide surface 114 contacts the strands.

Adjacent the recess or indentation 115 is a slot having an open end or notch 116. The recess or small hollow 115 and the open ended slot or groove 116 are in open communication with one another such that the strand moved along the guide surface 114 to the recess 115 is moved into the notch 116 during transfer of strand from one collet to another as described above. During turret transfer of the strand from one collet to another as discussed earlier, the strand 102*a* moves into the open slot 116 from the recess 115. The open slot 116 is effective to hold the strand in the knock off while the strand is being transferred from the temporary collection region of one collet to the temporary collection region of a second collet. After transfer the strand moves to the recess 115 which tends to pull the strand from the temporary collection region to the package collection regions when the push off is retracted.

As shown in FIG. 14 the guide surface 114 is at an obtuse angle to the path of travel of the knock off 112 and has a positive rake. At one end of the guide surface 114 is the recess 115. The recess being at an acute angle to the path of travel of the knock off 112 and has a negative rake. The recess can be an indented small (relative to guide 114) guide surface. Also the guide surface 114 could end with a radius (such as 1/16 of an inch) and that curved surface could define the recess 115.

The knock off 112 remains in its extend position so that the strand moves vertically from the knock off to the temporary collection region for collection in that region. The knock off remains in its extended position so long as it is desired to have the strand being wound in the temporary collection region. It may be desired to have strand wound in the temporary collection region until the collet has reached the desired package collection speed. When it is desired that the strand move from the temporary collection region to the package collection region of the collet the knock off retracts. Upon retraction of the knock off the strands are gathered in the recess or small hollow 115. This recess 115 tends to hold the strands therein while the knock off is recessed thus tending to pull the strands from the temporary collection region toward the package collection region of the collet. When push off retracts behind normal strand line 100, the strand tension removes the strand(s) from the recess 115 and the strands are engaged by their respective oscillator means for package build. Thus, as the push off retracts, first one strand is dropped off for engagement by its oscillator and package build and then the other strand in its package collection region. When the push off 112 is fully retracted the push off is not in contact with the strand and the strand is oscillated and wound in its package collection region.

Figure 15:
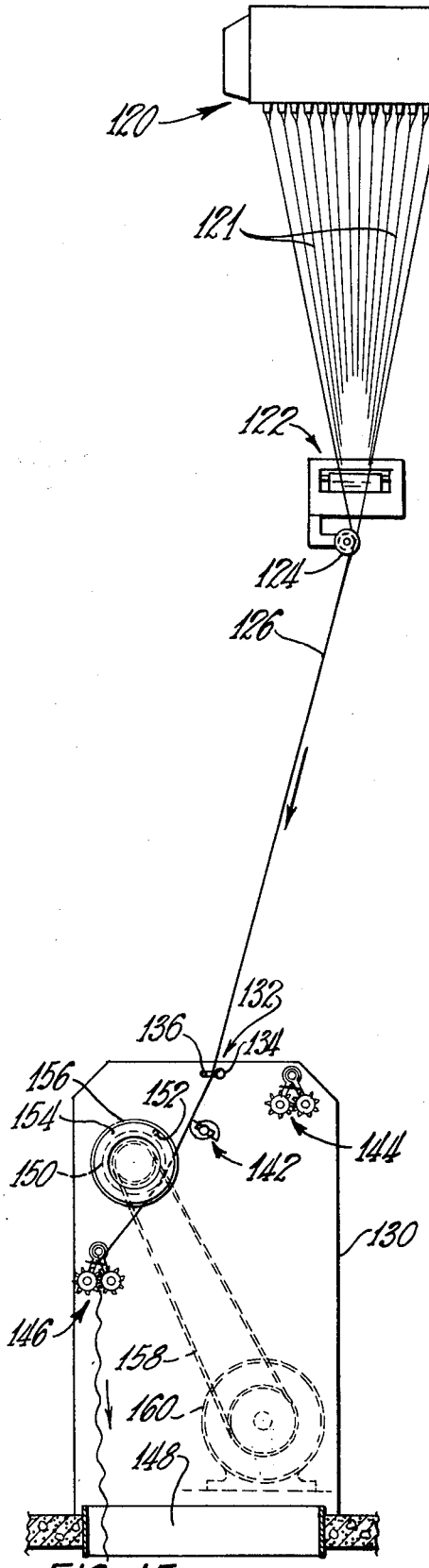
FIG. 15 is a somewhat diagrammatic front elevation view of the apparatus of the invention employed on a winder packing continuous filament strand at a forming position.
Figure 16:
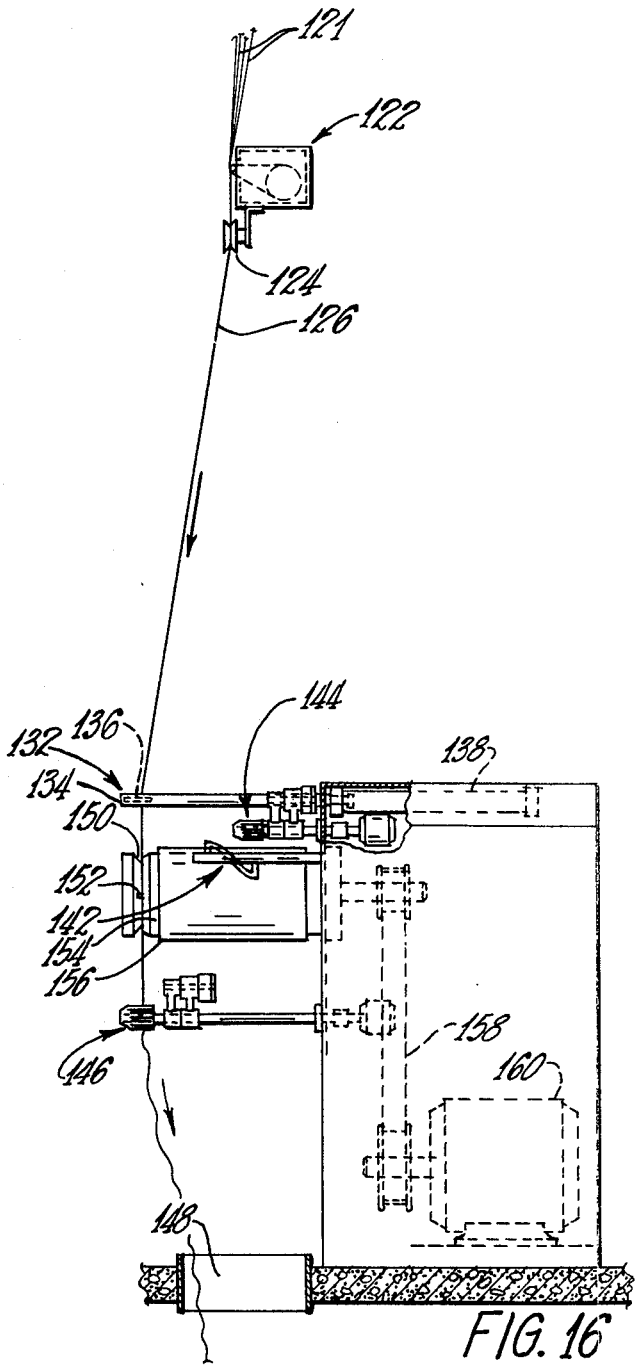
FIG. 16 is a side elevation view of the apparatus illustrated in FIG. 15.

FIGS. 15 and 16 show another embodiment of the invention. A process for forming continuous glass filaments from heat softened glass where the glass filaments are combined into a strand which is subsequently collected as a wound package is shown.

In FIG. 15 a container or feeder 120 is shown holding a supply of molten glass. The container 120 may be connected to a forehearth (not shown) that supplies molten glass from a furnace or may be connected to a means for supplying glass (not shown) such as glass marbles that are reduced to a heat-softened condition in a melter or other means associated with a feeder 120. The feeder assembly 120 is similar to that described in FIG. 1. Glass filaments 121 are coated with a sizing material at the applicator assembly 122 and gathered into a strand 126 at a strand guide 124. This size applicator system is similar to that described in FIG. 1. Parts of the winder assembly shown in FIGS. 15 and 16 is similar to that described in U.S. Pat. No. 3,539,317. Such patent is herein incorporated by reference.

When the strand is not being wound it can be pulled by the pull roll assembly 144. This pull roll assembly is described in the above referenced patent. This temporary advancing means or interim means advances the strand 126 as waste to a waste collecting area through the scrap chute 148. The strand is introduced between the cooperating moving surfaces of the rollers which rotate together to advance the strand downwardly.

To start a new package being wound the strand 126 is introduced to the pulling assembly 146. This pulling assembly is positioned beneath the collet 154 and in such a position that when the strand is pulled by the assembly 146 the strand contacts the collet 154 and the temporary collection region of the collet. The position can be such that the strand is bent across or turned on the collet in the temporary collection region. The puller assembly 146 is shown to be similar to the pulling assembly 144. The pulling assembly could of course be a pneumatic pulling system, pull roll or any conventional strand pulling means. The strand is delivered from the pulling system 146 through the scrap chute 148 to a waste collection area. When the strand is introduced to the pulling assembly 146, the knock off or push off assembly should be in its extended position as shown in FIG. 16. Therefore the strand 126 is advanced by the pulling assembly or interim means 146 vertically from the push off down through the temporary collection region of the collet 140. It is also within the scope of the invention that the pulling means also include a collecting means to collect the pulled strand as waste.

The temporary collection region of the collet 154 is similar to that described earlier. It has a guide surface or groove 150 and a fixed or stationary member 152. The strand advancing through the temporary collection region contacts the collet in the region and is guided into engagement with the fixed member 152. In other words, the interim means 146 advances the strand or linear element 126 for start up during times the element 126 is not collected on the collet 154. The interim means 146 being located in space relationship with the collet 154 in a position effective to advance the element 126 along a path that brings the element into contact with the collet in the temporary collection region so that the fixed member 152 can engage the element during rotation of the collet to begin collection of the element on the collet and to affect severenace of the element between the collet and the interim means. As discussed earlier, once the strand has been engaged by the member the strand will be advanced in one direction by the temporary advancing means and it will be urged in a second direction by the interim means 146 thus causing fracture and severance of the strand between the collet and the interim means.

Once collection in the temporary collection region has begun, the strand knock off can hold the element for collection in the temporary collection region until the collet is at a desired rotating speed. The knock off can be retracted when the collet has reached the desired speed. When the knock off is retracted the strand moves laterally into the package collection region for package formation.

The collet has been shown with one package collection region but is is within the scope of the invention that the collet have more than one package collection region. For example, the collet could be similar to that described in FIG. 13 where there are two package collection regions and a single temporary strand collection region. The temporary strand collection region is shown at the free end of the collet. It is also within the scope of the invention to have the temporary collection region located at the inside end of the collet. And if the collet had two package collection regions it could also have two temporary collection regions, one being at the end of the collet and the other being at the mid region or at the other end of the collet.

Figure 17:
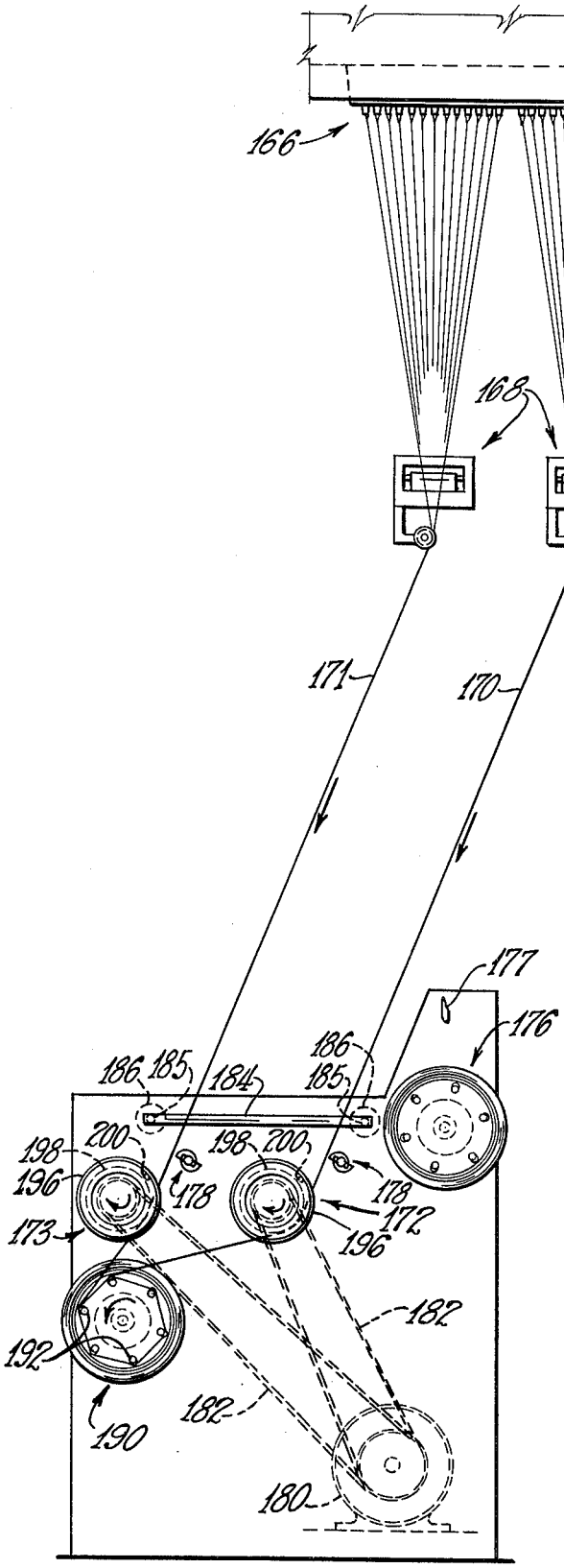
FIG. 17 is a somewhat diagrammatic front elevation view of apparatus according to the principles of the invention and that handles continuous filament strands at a filament forming position.
Figure 18:
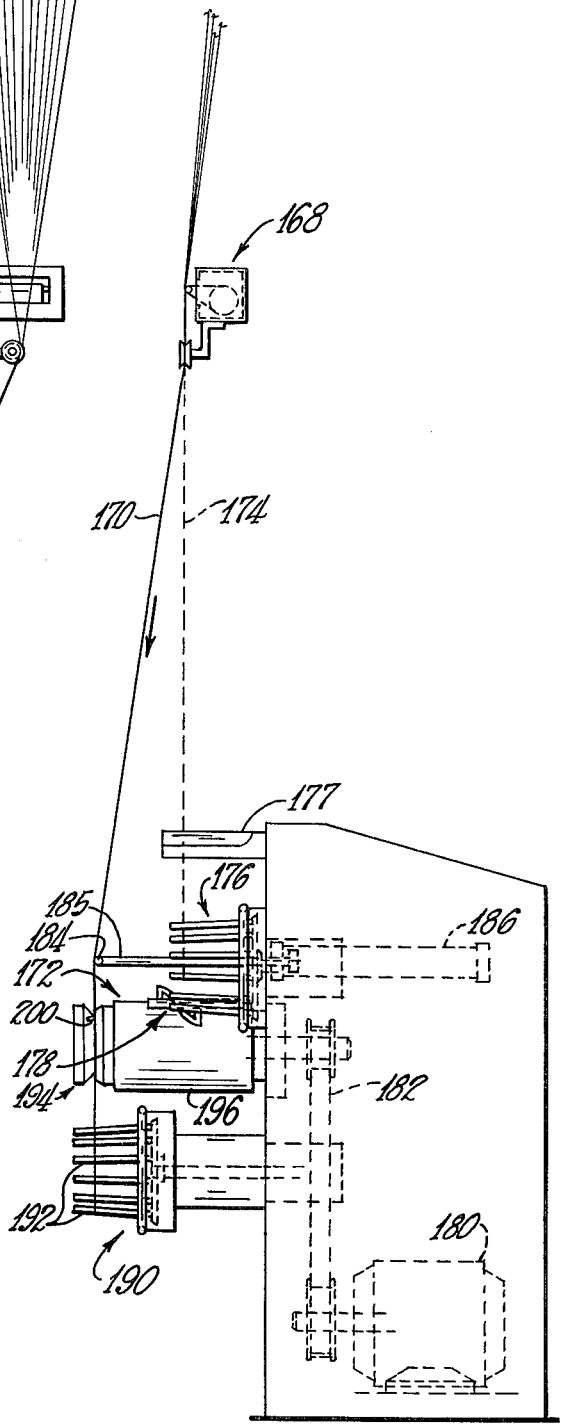
FIG. 18 is a side elevation view of the apparatus illustrated in FIG. 17.

FIGS. 17 and 18 show another embodiment of the invention. A winder is shown beneath a fiber forming station 166. The strands formed at the fiber forming station 166 are divided into two groups. Each group of filaments is coated with a size material at a size applicator 168. The two groups of coated filaments are then gathered into strands 170 and 171. The winder mechanism shown in FIGS. 17 and 18 has portions that are similar to that described in U.S. Pat. No. 3,666,431. That patent is herein incorporated by reference. Two collet assemblies 172 and 173 are rotated by a motor 180. As shown, each collet assembly has a package collection region and a temporary collection region. As discussed earlier, it is within the scope of the invention that each collet would collect more than one package.

When the strands are not to be collected on the collet they can be passed over the guide 177 and wound on the temporary advancing means or interim means 176. This interim means 176 is described in the referenced U.S. Patent. This advancing means includes a rotating member having a plurality of separated elongated members or surfaces around the axis of rotation of the member. The interim means 176 is spaced from the primary advancing means i.e. the collet on the winder. As shown the rotatable member is a disc located on a vertical wall of the winder housing. The disc is on a horizontally extending output shaft of a motor located within the housing. The elongated members are spaced apart rod-like fingers that extend away from the disc major surface. As shown, the temporary advancing means or interim means orients the fingers in a circular pattern about the axis of rotation of the disc to form a plurality of spaced apart elongated members around the axis of rotation of the disc, upon which the strands are advanced and collected. The circumferentially disposed fingers extend generally parallel to the axis of rotation of the disc.

This interim strand advancing arrangement can advance and collect the strands during times the strand is not being wound on the other interim advancing device 190 or upon the collets 172 and 173.

For start up of winding of the strand upon the collet, the strands 170 and 171 together are advanced and collected on the interim means 190. The interim means 190 is similar in configuration to the other interim or preliminary advancing means 176 just described. This interim means advances both strands 170 and 171 to the respective collets simultaneously. It is within the scope of the invention that the advancing means can be other advancing means as discussed earlier for example.

Each collet 172 and 173 has a temporary collection region and a package collection region thereon. Each collet has in its temporary collection region a fixed member in a position so that it is effective to engage its respective strand linearly advanced through the region. Each temporary collection region is shown to be at the free end region of its respective collet and each temporary collection region is shown to have a guide surface or groove 198 and a fixed pin 200 extending in the groove. The configuration of the end cap or temporary collection region has been discussed earlier.

The two collets 172 and 173 are in spaced apart side by side parallel relationship below the strand supply means. The interim means 190 advances and collects the strands 170 and 171 to simultaneously advance both strands to their respective collet temporary advancing stations for collection thereon. The single interim means being located in a spaced apart relation with the collets in a position effective to simultaneously advance both strands 170 and 171. The first strand 170 is advanced along a path that brings the strand into contact with the first collet 172 in the temporary collection region of the first collet so that the fixed member 200 can engage the first strand during rotation of the first collet to begin collection of the strand 170 on the collet 172 and to effect severance of the strand between the first collet and the interim means 190. The second strand 171 is simultaneously advanced by the single interim means 190 along a path that brings the strand 171 into contact with the second collet 173 in its temporary collection region so that the fixed member 200 can engage the strand 171 during rotation of the collet 173 to begin collection of the strand 171 on the collet 173 and to effect severance of the second strand 171 between the collet 173 and the single interim means 190. Once the strands have begun collection in the temporary collection region of their respective collets the strand is moved laterally along the collets to their respective package collection regions to begin package formation.

The strand knock off assembly works in a similar fashion as those already described. The knock off shown in FIGS. 17 and 18 in a horizontal bar 184 attached to 2 supports 185 which are moved by the activating means 186. The activating means may be a pneumatic means as discussed earlier. The strand push off 184 is shown in FIG. 18 in its extended position. The push off 184 contacts both strands and holds them so they drop generally vertically through the temporary collection region to the interim advancing and collecting meas 190. At start-up the strand knock off is in its extended position. Once the strand has begun collection in the temporary collection region of its respective collet the knock off is held in its extended position until the collet is up to its desired winding speed. Then the push off is retracted and the strands move laterally along the collets into their respective package collection regions. As illustrated in FIG. 18 the strand 170 moves laterally along the collet to the path 174.

Having described the invention in detail, it will be understood that such specifications are given for the sake of explanation. And various modifications and substitutions other than those cited may be made without departing from the scope of the invention as defined in the following claims.

I claim:

1. Apparatus for packaging a first and a second supplied strand comprising:

a. a rotatable collet having a first package collection region for collecting the first strand, a second package collection region for collecting the second strand and a temporary collection region;

b. a strand engaging member having a recess and a guide surface terminating at one end at the recess; and c. means for moving the member so that the strands can be moved along the collet between the package collection regions and the temporary collection region, the guide surface being disposed to first contact and laterally guide the first strand toward the recess and then contact and laterally guide the second strand toward the recess so that both strands are collected in the recess and are gathered into a single bundle therein when the member is moved along a path to move each strand from its respective package collection region to the temporary collection region, the recess being disposed tending to hold the single bundle therein and thus urge movement of the bundle of the strands with it when the member is moved back along the path such that each strand individually releases from the recess at its package collection region.

2. Apparatus of claim 1 wherein the member is spaced from the collet and moves along a path generally parallel with the axis of rotation of the collet.

3. Apparatus of claim 1 wherein the member has a notch in open communication with the recess.

4. Apparatus for producing and packaging glass strand comprising:

a. means for supplying streams of molten glass for attenuation into continuous glass filaments;

b. means for gathering the glass filaments into a first strand and a second strand;

c. a driven rotatable collet having a first package collection region for collecting the first strand, a second package collection region for collecting the second strand and a temporary collection region;

d. a strand engaging member spaced from the collet having a recess and a guide surface terminating at one end at the recess; and e. means for moving the member so that the strands can be moved along the collet between the package collection regions and the temporary collection region, the guide surface being disposed to first contact and laterally guide the first strand toward the recess and then contact and laterally guide the second strand toward the recess so that both strands are collected in the recess and are gathered into a single bundle therein when the member is moved along a path generally parallel with the axis of rotation of the collet to move each strand from its respective package collection region to the temporary collection region, the recess being disposed to hold the single bundle therein and thus move the bundle of the strands with it when the member is moved back along the path such that each strand individually releases from the recess at its package collection region.

5. The apparatus of claim 4 wherein the collet has an engaging element in the temporary collection region and the member moves the bundle of strands to the temporary collection region from the package collection regions so that the single bundle is engaged on the engaging element.

* * * * *